US005669703A

United States Patent [19]

Wheeler et al.

[11] Patent Number: 5,669,703

[45] Date of Patent: Sep. 23, 1997

[54] PUSH-IN BULB BASE FOR BAYONET-TYPE BULB SOCKETS

[75] Inventors: Keith D. Wheeler, Raleigh, N.C.; Robert Sehmer, Grafton, Wis.

[73] Assignee: Square D Company, Palatine, Ill.

[21] Appl. No.: 579,710

[22] Filed: Dec. 28, 1995

[51] Int. Cl.[6] ..... H01R 33/00

[52] U.S. Cl. ..... 362/249; 362/226; 362/457; 362/800; 439/356; 439/611

[58] Field of Search ..... 362/226, 249, 362/457, 800, 806; 439/336, 337, 356, 611, 616; 313/318.01, 318.12

[56] References Cited

U.S. PATENT DOCUMENTS

| | | | |
|---|---|---|---|
| 1,700,538 | 1/1929 | Grant et al. | 439/336 |
| 3,215,972 | 11/1965 | Eriksson | 439/611 |
| 5,029,056 | 7/1991 | Patterson, Jr. | 362/226 |
| 5,057,982 | 10/1991 | Hanami | 362/226 |
| 5,160,201 | 11/1992 | Wrobel | 362/249 |

FOREIGN PATENT DOCUMENTS

| | | | |
|---|---|---|---|
| 20619 | of 1907 | United Kingdom | 439/336 |

*Primary Examiner*—Alan Cariaso
*Attorney, Agent, or Firm*—Larry I. Golden; David R. Stacey; Larry T. Shrout

[57] ABSTRACT

A push-in bulb base for use in a bayonet-type bulb socket. The push-in base does not require turning of the bulb base to engage the retaining bayonets of the bulb base in the L-shaped retaining slot of the bulb socket. The push-in bulb base has integrally formed flexible retainers which flex inward during installation and then flex back to their normal position to engage the L-shaped retaining slots of the bulb socket. An integrally formed alignment rib prevents the bulb base from being inserted into the bulb socket in a position that would prohibit the engagement of the retainer with the L-shaped retaining slot.

48 Claims, 7 Drawing Sheets

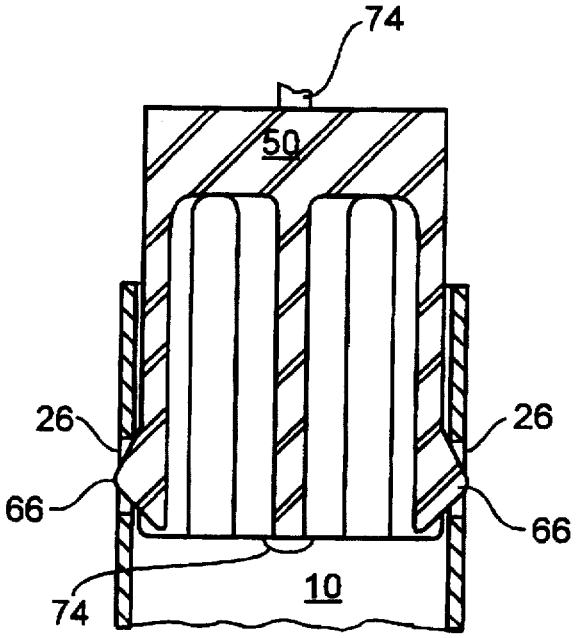
Fig. 7
Fig. 10
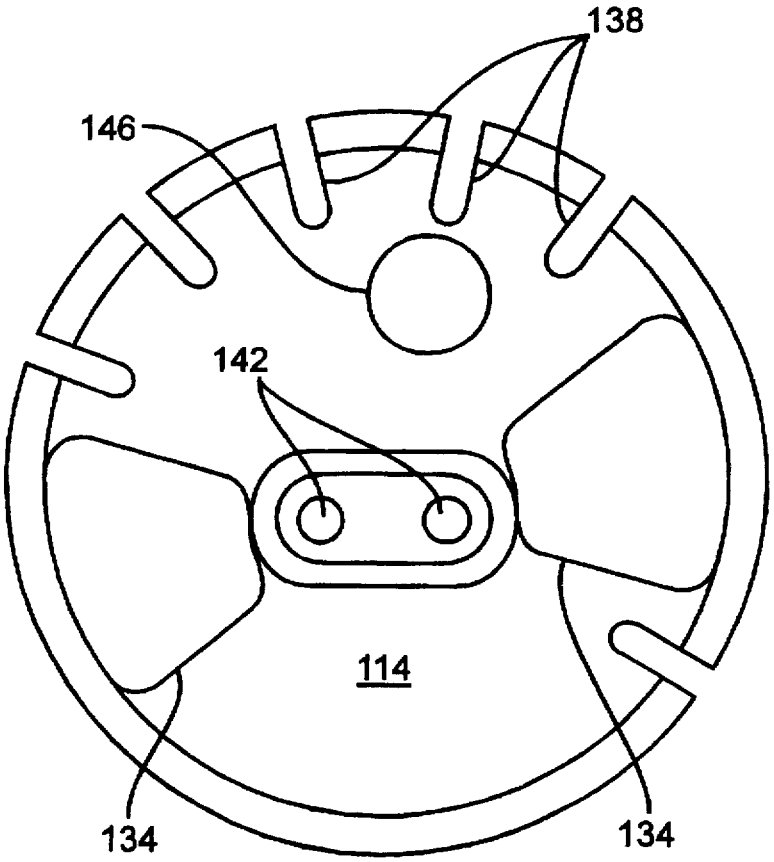

PUSH-IN BULB BASE FOR BAYONET-TYPE BULB SOCKETS

FIELD OF THE INVENTION

The invention relates to the field of illuminated indicators and specifically to bayonet-type bulb sockets and a push-in bayonet-type bulb base for those sockets.

BACKGROUND OF THE INVENTION

It is known to use incandescent light bulbs with bayonet-type bases as indicator lights. However, since incandescent lights tend to have a short life span and therefore require periodic replacement it is desirable to have a light source which has a much longer life expectancy and that can also be retrofitted to the incandescent bulb applications. The LED is becoming a viable and desirable replacement for incandescent indicator lights since the LED has a long life and generally draws low current. However, a single LED does not produce the same amount of light as a single incandescent bulb and it is therefore necessary to place a number of LED's in a cluster on a printed circuit board to produce the same light output. Since the printed circuit board must be attached to a bayonet-type bulb base in order to be a viable retrofit for the incandescent bulb it must also be able to rotate such that the bayonet-type base can be properly installed in the bulb socket. This can be a significant problem since the shape or size of the printed circuit board may prohibit rotation in many applications. One method of solving this problem is disclosed in U.S. Pat. No. 4,965,457 to Wrobel et al. wherein a rectangular printed circuit board is rotatably connected to the bayonet-type bulb base such that the bulb base may be both rotated independently of the printed circuit board and moved perpendicularly with respect to the printed circuit board. This approach requires a number of additional movable parts to provide the required rotation of the bayonet-type bulb base during installation in the bulb socket. It would be desirable to accomplish the same function with an inexpensive one piece bayonet-type bulb base which does not require any rotation to be properly installed within a bayonet-type bulb socket. This push-in bayonet-type connection would also be desirable in other applications where rotation of the device being installed is difficult. This could include incandescent lights or other electrical or electronic components having a bayonet-type base.

SUMMARY OF THE INVENTION

The Present invention, in its preferred embodiment, provides a one piece molded push-in bulb base which may be pushed straight into a bayonet-type bulb socket and retained therein without requiring any rotation of the bulb base to effect the retaining thereof. The push-in bulb base is intended to be a easily installed direct replacement for fixed bayonet-type bulb bases which are presently the only available bulb bases which can be used with commercially available bayonet-type bulb sockets having an L-shaped retaining groove. The push-in bulb base of the present invention can be used with incandescent bulbs, LED retrofit devices for replacing incandescent bulbs or any other application in which a connection to a bayonet-type socket is required. The push-in bulb base or the present invention includes a body dimensioned to be received within a bayonet-type bulb socket. The body includes a retainer which is selectively movable between a normally biased first position and a second position in response to the bulb base being pushed into the bayonet-type bulb socket. The body also includes an integrally formed alignment member which orients the bulb base in the bulb socket such that the retainer is properly aligned with a horizontal leg of the L-shaped groove and such that the electrical terminals of the bulb base and the bulb socket will be properly connected.

BRIEF DESCRIPTION OF THE DRAWINGS

FIG. 7 is a cross-sectional view of a bulb socket with a fully inserted bulb base in accordance with the present invention.

FIG. 10 is a top view of a LED cluster retrofit device in accordance with the present invention.

Figure 1:
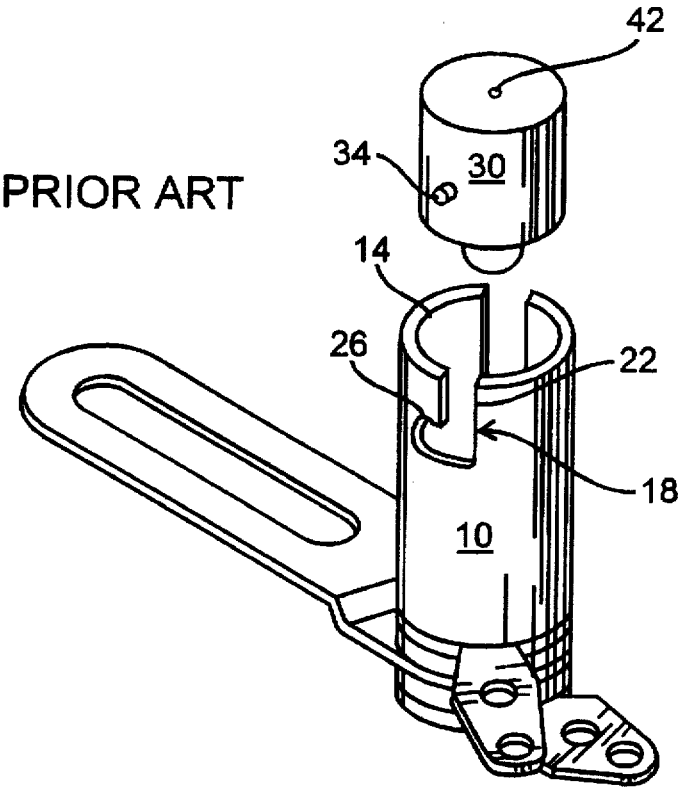
FIG. 1 is an isometric view of a prior art bulb socket and bulb base.

Before one embodiment of the invention is explained in detail, it is to be understood that the invention is not limited in its application to the details of construction and description or illustrated in the drawings. The invention is capable of other embodiments and of being practiced or being carried out in various other ways. Also, it is to be understood that the phraseology and terminology used herein is for the purpose of description and should not be regarded as limiting.

DESCRIPTION OF THE PREFERRED EMBODIMENT

FIG. 1 represents one embodiment of a bayonet-type bulb socket generally indicated by reference numeral 10. The bulb socket 10 is generally cylindrical in shape and has a generally circular opening 14 at one end. In this embodiment the bulb socket 10 has at least one L-shaped retaining slot 18. The one L-shaped slot 18 could also be an L-shaped groove formed in the bulb socket 10. There are, in most cases, two generally opposed slots 18 in each bulb socket 10. Each L-shaped slot 18 has a vertical leg 22 and a horizontal leg 26. A bayonet-type bulb base generally indicated by reference numeral 30 is typical of the prior art. The bulb base 30 includes at least one generally cylindrical bayonet 34 which extends outwardly from the surface of the bulb base 30.

Figure 2:
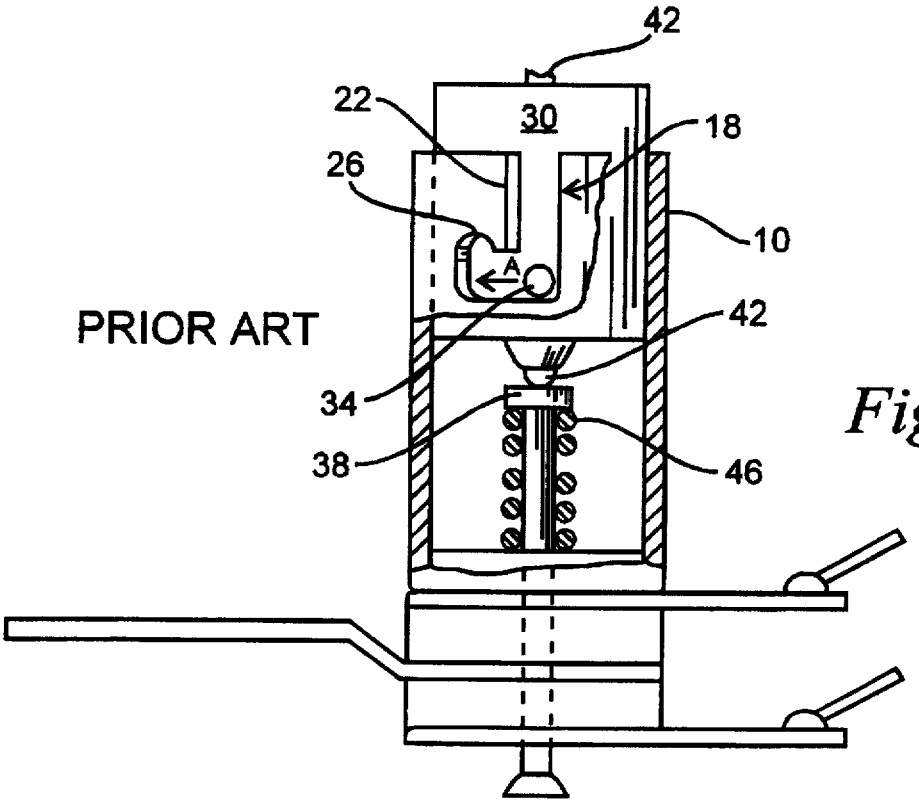
FIG. 2 is a partial section view of a prior art bulb socket and bulb base.

Referring now to FIG. 2, the bulb base 30 is dimensioned to be slidably received within the cylindrical opening 14 and the bayonet 34 is dimensioned to be slidably received within the L-shaped slot 18. As the bulb base is slidably received within the cylindrical opening 14, the bayonet 34 is slidably received within the vertical leg 22 of the L-shaped slot 18. To retain the bulb base 30 within the bulb socket 10 the bulb base 30 must be rotated as indicate by the arrow A in FIG. 2 such that the bayonet 34 is received in the horizontal leg 26 of the L-shaped slot 18. In the embodiment of FIGS. 1 and 2, the bulb socket 10 and the bulb base 30 form one of the current carrying electrical conductors with the electrical connection between the two being made by the physical contact between the bayonet 34 of the bulb base 30 and the horizontal leg 26 of the L-shape slot 18 in the bulb base 10. The other electrical connection is made by the physical contact between an electrical terminal 38 located in the bulb socket 10 and an electrical terminal 42 located at one end of the bulb base 30 and extending generally through the center of the bulb base 30. The terminal 38 is biased toward the opening 14 by a spring 46. This biasing causes the bayonet 34 to be forced against the horizontal leg 26 of the L-shaped slot 18 thereby forcibly retaining the bulb base 30 within the bulb socket 10. This arrangement is common in most direct current (DC) applications. In other applications the bulb socket 10 and bulb base 30 may not carry current or they may be made from nonconductive materials. It may therefore be desirable to have more than one electrical terminal 42 enclosed within the bulb base 30 and extending generally along its longitudinal axis. Applications of this type also require additional terminals 38 in the bulb socket 10. These additional terminals 38 and 42 are generally of different electrical polarity or electrical potential and may be connected to elements having different electrical functions. It is therefore required that the terminals 42 of the bulb socket 30 requiring a particular polarity, potential or function be connected only to terminals 38 of the bulb socket 10 providing the appropriate polarity, potential or function. This is generally accomplished by keying the position of the bayonets 34 of the bulb base 30 to coincide with a particular configuration of the L-shaped slots 18 in the bulb socket 10. The L-shaped slots 18 are configured such that the bulb base 30 can only enter the opening 14 and be retained therein in one particular orientation. One method of configuring the L-shaped slots 18 is to select some rotational angle other than 180° to space them apart. Another method is to make one of the vertical legs 22 longer than the other such that the bulb base 30 can only be fully inserted and retained in the bulb socket 10 in one particular orientation.

Figure 3:
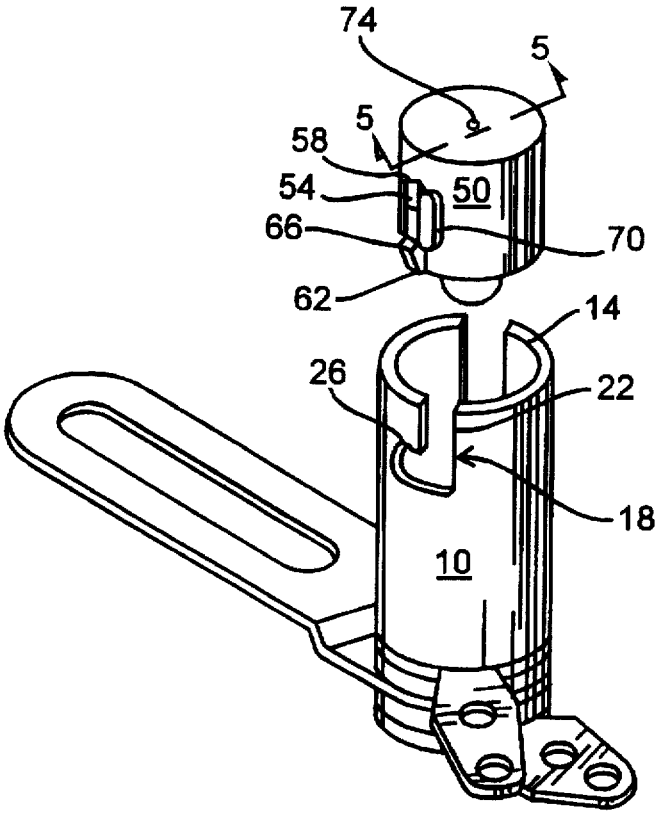
FIG. 3 is an isometric view of a bulb socket and bulb base in accordance with the present invention.

Referring now to FIG. 3, a push-in bulb base of the present invention is generally indicated by reference numeral 50. The push-in bulb base 50 is intended to be a direct replacement for the push and twist bayonet-type bulb base 30 which is currently the only available form of bayonet-type bulb base which can be used with a commercially available bayonet-type bulb socket 10. The bulb base 50 is preferably a molded part and may be made from either an electrically insulating or an electrically conductive material. One or more retainer levers 54 are integrally formed from the bulb base 50. Each retainer lever 54 is flexibly attached to the base 50 by a proximate end 58. Each retainer lever 54 also has a distal end 62 from which a retainer 66 is integrally formed. Each retainer 66 extends outwardly from the retainer lever 54 and generally perpendicularly to the surface of the bulb base 50. The bulb base 50 also has at least one alignment rib 70 located immediately adjacent and generally parallel to at least one of the retainer levers 54. The alignment rib 70 is preferably rectangular in shape and integrally formed from the bulb base 50 such that it also extends outwardly from and generally perpendicularly to the surface of the bulb base 50.

Figure 4:
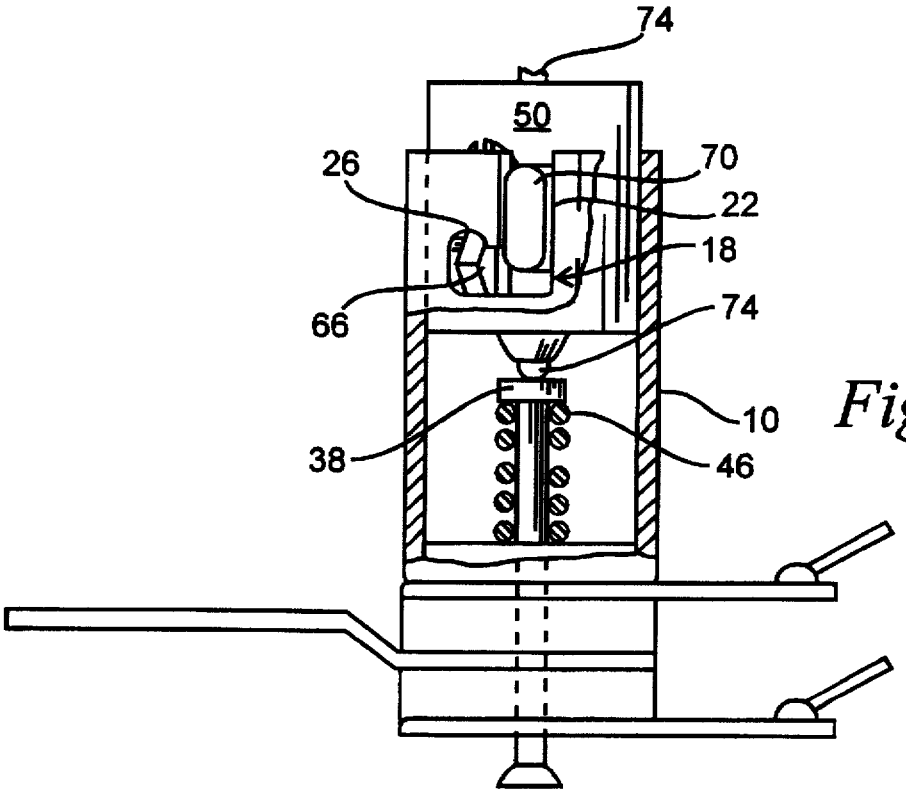
FIG. 4 is a partial section view of bulb socket and bulb base in accordance with the present invention.

Referring now to FIG. 4, at least one electrical terminal 74 extends through the bulb base 50 generally along its longitudinal axis. The electrical terminals 74 are positioned in the bulb base 50 such that they will make be aligned with their associated electrical terminals 38 in the bulb socket 10 when the bulb base 50 is properly aligned and fully inserted into the opening 14 of the bulb socket 10. Proper alignment of the bulb base 50 with the bulb socket 10 is accomplished as the bulb base 50 is pushed into the bulb socket 10. As the bulb base 50 is slidably received in the opening 14 the alignment rib 70 must be oriented such that it is slidably received in the vertical leg 22 of the L-shaped slot 18 of the bulb socket 10. The alignment rib 70 ensures that the electrical connectors 74 of the bulb base 50 are in proper alignment with the connectors 38 of the bulb socket 110.

Figure 5:
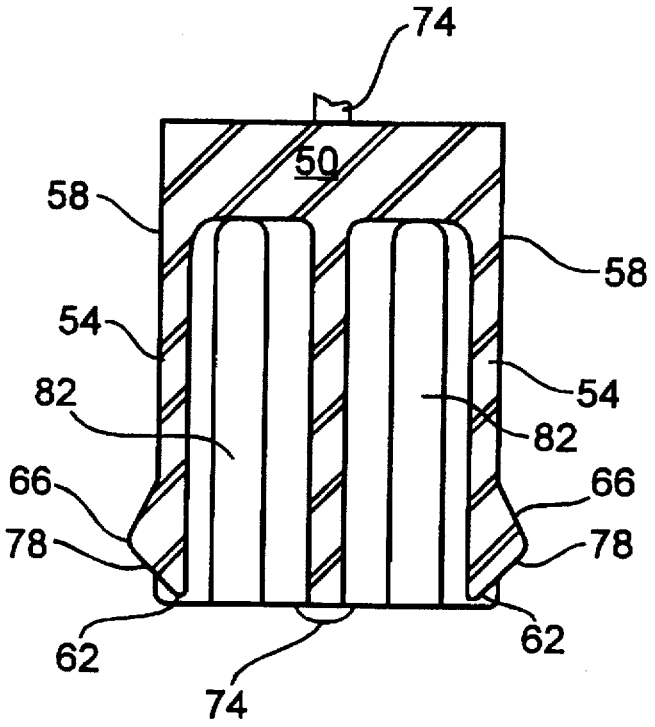
FIG. 5 is a cross-sectional view taken along line 5—5 of FIG. 3 of a bulb base in accordance with the present invention.
Figure 6:
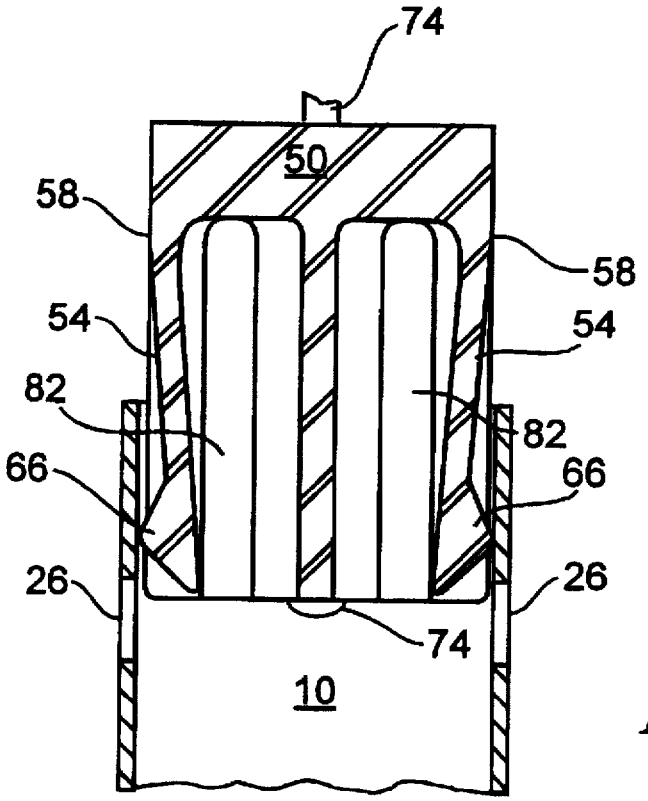
FIG. 6 is a cross-sectional view of a bulb socket with a partially inserted bulb base in accordance with the present invention.

Referring now to FIG. 5, a cross-section view of the bulb base 50 taken through section line 5—5 of FIG. 3 illustrates the retainer lever 54 in its normal or first position. At the distal end 62 of the retainer lever 54 is a angled lead-in surface 78 which engages the bulb socket 10 as the bulb base 50 is pushed into the opening 14. This lead-in surface 78 permits the retainer 66 to easily slide into the bulb socket 10 causing the retainer lever 54 to be flexed into a relief 82 located directly behind the retainer lever 54. FIG. 6 illustrates this flexed or second position of the retainer lever 54 while the bulb base 50 is only partially inserted into the bulb socket 10. FIG. 7 illustrates a cross-sectional view of the fully inserted bulb base 50. In this position the retainer lever 54 has again returned to its first position and the retainer 66 is received in the horizontal leg 26 of the L-shaped slot 18 thereby retaining the bulb base 50 in the bulb socket 10.

Figure 8:
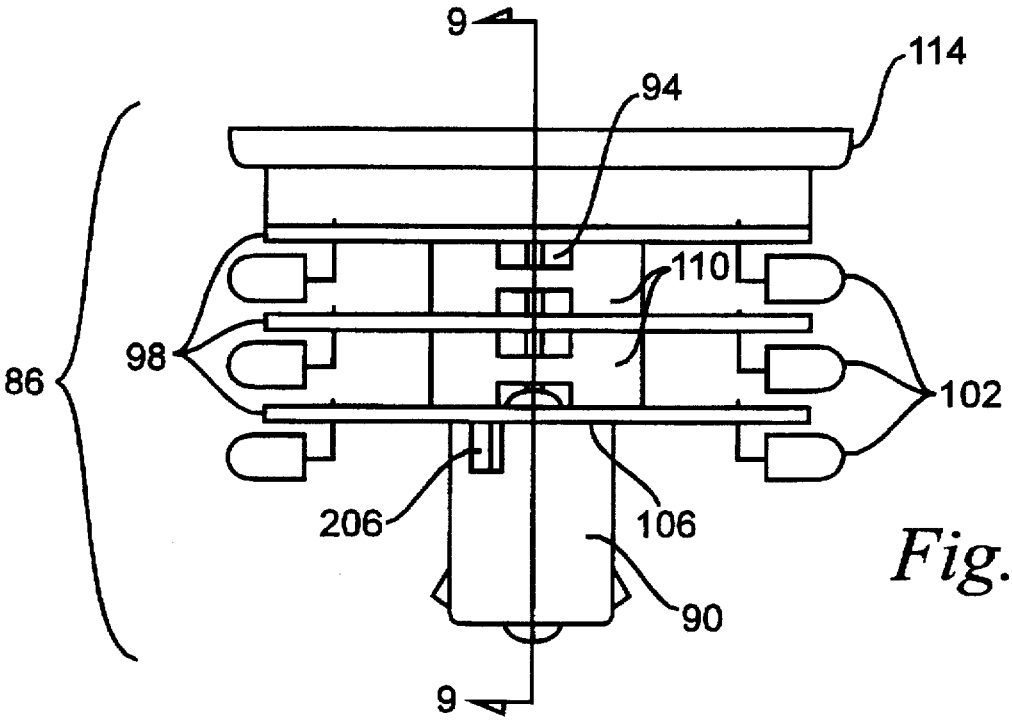
FIG. 8 is a side view of a LED cluster retrofit device in accordance with the present invention including multi-board LED clusters.

Referring now to FIG. 8, a LED cluster retrofit device is generally indicated by reference numeral 86. The LED cluster retrofit device 86 has a bulb base 90 which includes all of the previously described features of bulb base 50 and further includes an upper portion 94 for slidably receiving at least one printed circuit board 98 on which a number of LED's 102 are mounted. The first printed circuit board 98 rests on a circuit board support 106 integrally formed from the bulb base 90 and best seen in FIG. 9. When more than one printed circuit board 98 is required a spacer 110 is placed between adjacent printed circuit boards 98. A top plate 114 is installed above the last printed circuit board 98.

Figure 9:
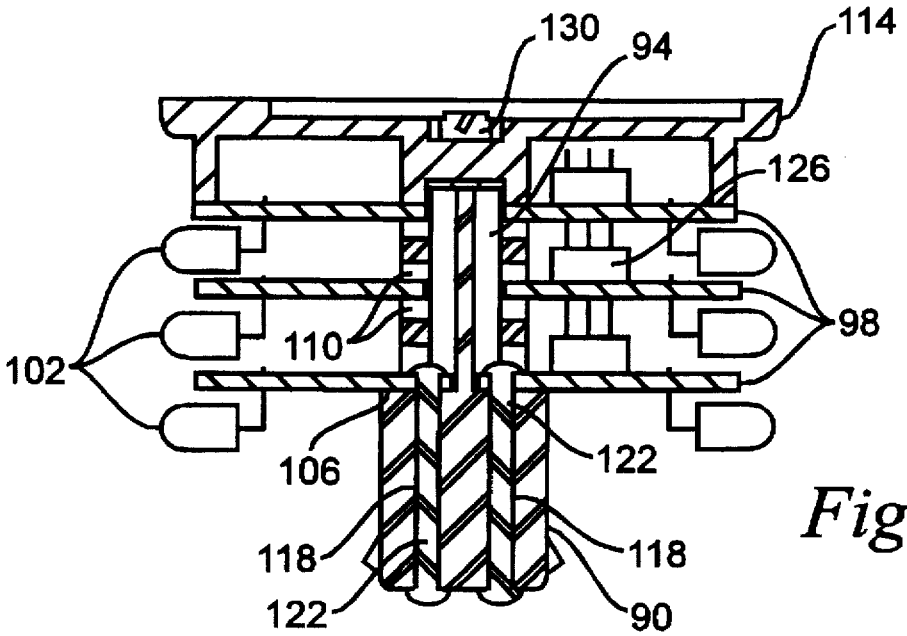
FIG. 9 is a cross-sectional view of a bulb base and LED cluster taken through section lines 9—9 of FIG. 8.

Referring now to FIG. 9, The bulb base 90 defines passages 118 extending through the bulb base 90 generally along its longitudinal axis. Each passage 118 receives one electrical terminal 122 which extends through the bulb base 90. One end of each electrical terminal 122 will make contact with a terminal 38 of the bulb socket 10 while the other end is electrically connected a conductor of the first printed circuit board 98 by means such as soldering. Each printed circuit board 98 includes a connector 126 for electrically connecting each of the stacked printed circuit boards 98 together. A screw 130 attaches the top plate 114 to the upper portion 94.

Referring now to FIG. 10, a top view of the top plate 114 reveals a pair of holes 134 such that the top plate 114 may be used as a handle for inserting and removing the LED cluster retrofit device 86 from the bulb socket 10. There are also a number of peripheral slots 138 which can be used as an alternative to the alignment ribs 70 as will be explained in the discussion of FIG. 15. Holes 142 are provide for receiving the attaching screws 130 and an additional clearance hole 146 is provided for a use to be discussed later.

Figure 11:
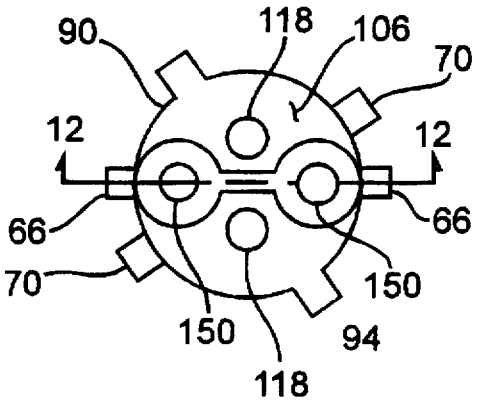
FIG. 11 is a top view of a bulb base for use with the LED cluster retrofit device in accordance with the present invention.

Referring now to FIG. 11, a top view of the bulb base 90 is shown. The upper portion 94 is generally figure-8-shaped in cross-section and includes holes 150 for receiving the top plate attaching screws 130. Also shown in this view are the circuit board support 106, aligning ribs 70, retainers 66 and terminal passages 118.

Figure 12:
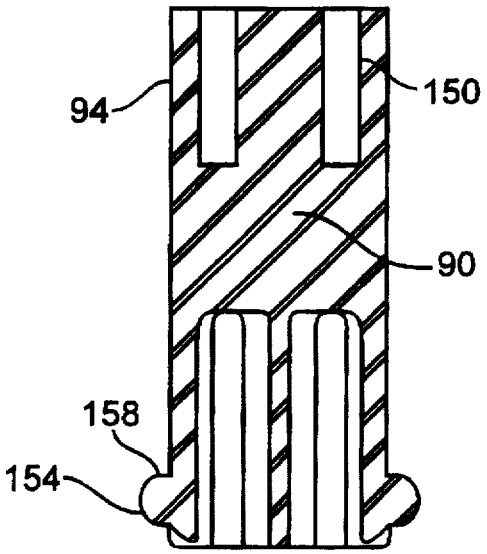
FIG. 12 is a cross-sectional view taken along section lines 12—12 of FIG. 11 of a bulb base for use with the LED cluster retrofit device in accordance with the present invention.

Referring now to FIG. 12, an alternate retainer 154 is illustrated. In this embodiment the retainer 154 is generally hemispherical in shape and has a short flat surface 158 at its junction with the retainer lever 54. The flat surface 158 provides a positive engagement between the retainer 154 and the horizontal leg 26 of the L-shaped slot 18.

Figure 13:
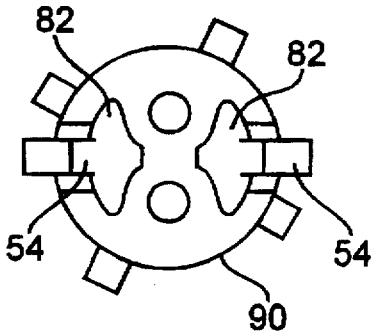
FIG. 13 is a bottom view of a bulb base for use with the LED cluster retrofit device in accordance with the present invention.

Referring now to FIG. 13 a bottom view of the bulb base 90 is shown. This view better illustrates the relief 82 with respect to the retainer lever 54.

Figure 14:
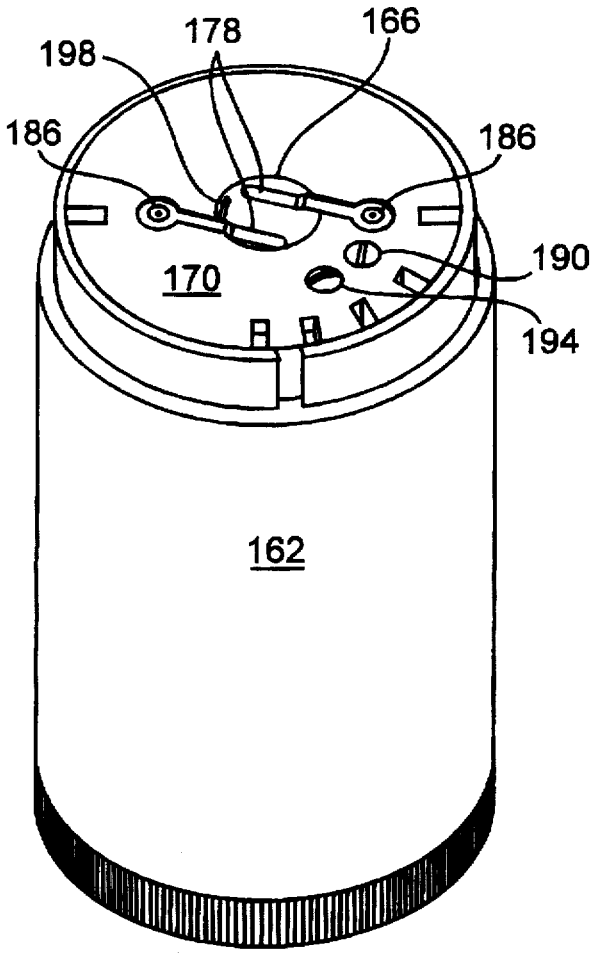
FIG. 14 is an isometric view of a stackable indicator lens with an integrally formed bayonet-type bulb base in which the LED cluster retrofit device in accordance with the present invention can be used.

FIG. 14 illustrates an indicator lens generally indicated by reference numeral 162 in which the LED cluster retrofit device 86 as described above Would be used. In this application the bulb socket 166 is integrally formed from a closed end 170 of the indicator lens 162 and the LED cluster retrofit device 86 is inserted through an open end 174 opposite the closed end 170. Electrical terminals 178 are attached to the closed end 170 of the indicator lens 162 and to internal electrical conductors 182 (shown in FIG. 15) by means such as rivets 186 and extend into the bulb socket 166. The electrical terminals 178 act as levers to provide the biasing force for the bulb base 90. The indicator lens 162 is attached to a base (not shown) by screw 190. Additional indicator lenses 162 may also be stacked one on top of the other and attached to each other by threading the screw 190 of the upper indicator lens 162 into a threaded hole 194 in the closed end 170 of the lower indicator lens 162. The screw 190 passes through the clearance hole 146 (see FIG. 10) in the top plate 114 and also through clearance holes (not shown) in each of the printed circuit boards 98. A segment of a horizontal leg 198 of an integrally formed L-shaped groove can be seen inside the bulb socket 166.

Figure 15:
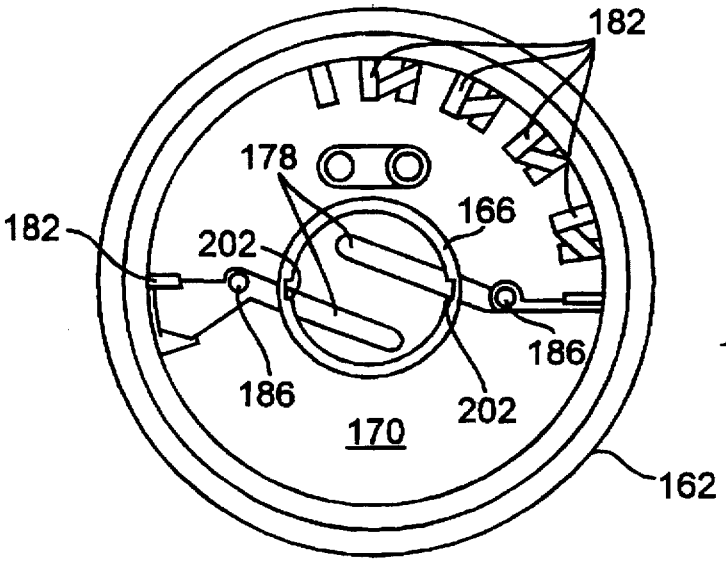
FIG. 15 is an inside view of the stackable indicator lens of FIG. 14.

Referring now to FIG. 15, an inside view of the indicator lens 162 from the open end 174 better illustrates the integrally formed bulb socket 166 and the internal electrical conductors 182. The vertical legs 202 of the integrally formed L-shaped grooves are shown in bulb socket 166. The internal electrical conductors 182 are radially positioned along the inside wall of the indicator lens 162 and extend generally between the closed end 170 and the open end 174. The peripheral slots 138 (see FIG. 10) located in the top plate 114 and corresponding peripheral slots (not shown) in the printed circuit boards 98 are positioned to receive the internal electrical conductors 182 as the LED cluster retrofit device 86 is inserted into the open end 174 of the indicator lens 162. Thus the interaction of the peripheral slots 138 with the internal electrical conductors 182 acts as an alignment means to ensure that the bulb base 90 is properly orientated with the bulb socket 166 such that the electrical terminals 122 of the bulb base 90 will make contact with the correct electrical terminals 178 of the bulb socket 166. An alignment rib (not shown) extending generally between the closed end 170 and the open end 174 could be used to replace the electrical conductors 182 for the purpose of aligning the LED cluster retrofit device 86. In an application where the top plate 114 or some other part of the LED cluster retrofit device 86 is employed to provide alignment between the bulb base 90 and the bulb socket 166 the alignment ribs 70 of bulb base 50 may be omitted. There may however be a need for a stop member 206 as shown in FIG. 8. The stop member 206 prevents the bulb base 90 from being inserted to far into a bulb socket 166 which has only flexible electrical terminals 178 to stop the insertion of the bulb base 90. The stop member 206 engages a top edge of the bulb socket 166 when the bulb base 90 has been inserted to its proper depth.

It is understood that many variations of the disclosed embodiment such as spring biased retainers, printed circuit boards of other geometric shape and electrically conductive bulb bases are possible and fall under the scope of the invention.

We claim:

1. A push-in bulb base for being received and retained in a commercially available bayonet-type bulb socket having at least one L-shaped retaining groove or slot, said bulb base comprising;

a body being generally cylindrical in shape and dimensioned to be slidably received within the bulb base;

at least one electrical terminal, said electrical terminal extending through said body generally along its longitudinal axis such that an electrical connection can be made with an electrical terminal of the bulb socket;

means for selectively retaining said bulb base in the bulb socket, said retaining means being normally biased to a first position wherein said retaining means engages a horizontal leg of the L-shaped groove or slot of the bulb socket and movable to a second position in response to pushing said bulb base into the bulb socket or pulling said bulb base from the bulb socket, and;

means for aligning said bulb base in the bulb socket such that said retaining means is properly aligned with the horizontal leg of the L-shaped groove or slot.

2. The bulb base of claim 1 wherein said means for retaining includes a retaining lever integrally formed from said body and being flexibly attached to said body at a proximate end, said retaining lever having a distal end movable said first between and second positions.

3. The bulb base of claim 2 wherein said retaining lever further includes a retainer integrally formed from said distal end, said retainer extending outwardly from said retaining lever and being generally perpendicularly to said body such that said retainer is selectively received in and engaged with the horizontal leg of the L-shaped groove or slot when said retaining lever is in said first position and thereby retaining said bulb base in the bulb socket.

4. The bulb base of claim 3 wherein said retainer includes a lead-in surface for slidably engaging an edge of the bulb socket.

5. The bulb base of claim 4 wherein said retainer is generally wedge-shaped cross-section.

6. The bulb base of claim 4 wherein said retainer is generally hemispherical in shape.

7. The bulb base of claim 6 wherein said retainer includes a short generally flat surface at its intersection with said retainer lever for providing a positive engagement with the horizontal leg of said L-shaped groove or slot.

8. The bulb base of claim 1 wherein said means for aligning includes an alinging rib integrally formed from said body, said aligning rib being generally rectangular in shape and extending outwardly and generally perpendicularly to said body, said aligning rib being slidably received in a vertical leg of the L-shaped groove or slot as said bulb base is pushed into the bulb socket.

9. The bulb base of claim 1 wherein said body further includes an upper portion for slidably receiving at least one printed circuit board on which a plurality of LED's are connected.

10. A push-in bulb base for being received and retained in a commercially available bayonet-type bulb socket having at least one L-shaped retaining groove or slot, said bulb base comprising;

a generally cylindrical body dimensioned to be slidably received within the bulb socket;

at least one electrical terminal, said electrical terminal extending through said body generally along its longitudinal axis such that an electrical connection can be made with an electrical terminal of the bulb socket;

at least one retainer lever integrally formed from said body and flexibly connected to said body at a proximate end such that a distal end is normally in a first position and is movable to a second position in response to said bulb base being pushed into the bulb socket;

retaining means integrally formed from said distal end of said at least one retainer lever such that said retaining means selectively engages a horizontal leg of the L-shaped groove or slot of the bulb socket thereby retaining said bulb base in the bulb socket, and;

means for aligning said bulb base in the bulb socket such that said retaining means and the horizontal leg of the L-shaped groove or slot are properly aligned.

11. The bulb base of claim 10 wherein said means for aligning includes at least one alignment rib integrally formed from said body and positioned to be slidably received in a vertical leg of the L-shaped retaining groove or slot of the bulb socket.

12. The bulb base of claim 10 wherein in said first position said retaining means extends outward from said body and in said second position said retaining means is biased by an inside surface of the bulb socket to a position generally flush with an outside surface of said cylindrical body.

13. The bulb base of claim 10 wherein said body further defines a relief immediately adjacent said retainer lever such that said retainer lever is received within said relieve as said retainer lever is moved to said second position.

14. The bulb base of claim 10 wherein said retaining means includes a lead-in surface for slidably engaging the inside surface of the bulb socket.

15. The bulb base of claim 14 wherein said retainer is generally wedge-shaped cross-section.

16. The bulb base of claim 14 wherein said retainer is generally hemispherical in shape.

17. The bulb base of claim 16 wherein said retainer includes a short generally flat surface at its intersection with said retainer lever for providing a positive engagement with said horizontal leg of said L-shaped groove or slot.

18. The bulb base of claim 10 wherein said bulb base includes a second retainer lever diametrically opposed to said at least one retainer lever, said second retainer lever having a retaining means at its distal end for engaging a second horizontal leg of a second L-shaped retaining groove or slot diametrically opposed to the at least one L-shaped retaining groove or slot of the bulb socket.

19. A push-in base for being received and retained in a bayonet-type bulb socket having at least one L-shaped retaining groove or slot, said base comprising;

a generally cylindrical body dimensioned to be slidably received within the bulb socket and defining at least one electrical terminal passage extending through said body generally along its longitudinal axis;

at least one electrical terminal being substantially received within said at least one terminal passage such that an electrical connection can be made with an electrical terminal of the bayonet-type bulb socket;

at least one retainer lever integrally formed from said body and being flexibly connected to said body at a proximate end such that a distal end is movable between a first position and a second position in response to said base being pushed into the bayonet type bulb socket;

retaining means integrally formed from said distal end such that said retaining means selectively engages a horizontal leg of the L-shaped groove or slot of the bulb socket, and means for aligning said base in the bulb socket such that said retaining means is properly aligned with the horizontal leg of the L-shaped groove or slot and said at least one electrical terminal of said base is properly aligned for making contact with a particular electrical terminal of the bulb socket.

20. The bulb base of claim 19 wherein said means for aligning includes at least one alignment rib integrally formed from said body and positioned to be slidably received in a vertical leg of the L-shaped retaining groove or slot of the bulb socket.

21. The push-in base of claim 19 wherein in said first position said retaining means extends outward from said body and in said second position said retaining means is biased by an inside surface of the bulb socket to a position generally flush with an outside surface of said body.

22. The push-in base of claim 19 wherein said body further defines a relief immediately adjacent said retainer lever such that said retainer lever is received within said relieve as said retainer lever is moved to said second position.

23. The push-in base of claim 19 wherein said retaining means includes a lead-in surface for slidably engaging the inside surface of the bulb socket.

24. The push-in base of claim 23 wherein said retainer is generally wedge-shaped cross-section.

25. The push-in base of claim 23 wherein said retainer is generally hemispherical in shape.

26. The push-in base of claim 25 wherein said retainer includes a short generally flat surface at its intersection with said retainer lever for providing a positive engagement with said horizontal leg of said L-shaped groove or slot.

27. The push-in base of claim 19 wherein said bulb base includes a second retainer lever diametrically opposed to said at least one retainer lever and having a retaining means at its distal end for engaging a second horizontal leg of a second L-shaped retaining groove or slot diametrically opposed to the at least one L-shaped retaining groove or slot of the bulb socket.

28. The push-in base of claim 19 wherein said base includes an upper portion for slidably receiving at least one printed circuit board having a plurality of LED's attached thereto.

29. The push-in base of claim 28 wherein said electrical terminal of said base is electrically connected to said printed circuit board.

30. The push-in base of claim 29 wherein additional said printed circuit boards are slidably received on said upper portion, each of said additional printed circuit boards being spaced apart one from another by a spacer slidably received on said upper portion.

31. The push-in base of claim 30 wherein said additional printed circuit boards are electrically connected together by a pin-type electrical connector.

32. The push-in base of claim 28 wherein said base further includes a top plate attached to said upper portion, said top plate for protecting said printed circuit boards and providing a handle for inserting and removing said base from the bulb socket.

33. A push-in bulb base for being received in a bayonet-type bulb socket integrally formed from and substantially enclosed by a translucent housing, the bulb socket having at least one L-shaped retaining groove or slot, said bulb base comprising;

a body generally cylindrical in shape and dimensioned to be received within the bulb socket, said body defining at least one electrical terminal passage extending generally along its longitudinal axis and having an upper portion for slidably receiving at least one printed circuit board having a plurality of LED's attached thereto;

at least one electrical terminal being substantially received within said at least one terminal passage and electrically connected to said at least one printed circuit board, said electrical terminal providing an electrical connection between said at least one printed circuit board and an electrical terminal of the bayonet-type bulb socket;

means for selectively retaining said bulb base in the bulb socket, said retaining means being normally biased to a first position wherein said retaining means engages a horizontal leg of the L-shaped groove or slot of the bulb socket and movable to a second position in response to pushing said bulb base into the bulb socket or pulling said bulb base from the bulb socket, and;

means for aligning said bulb base in the bulb socket such that said retaining means is properly aligned with the horizontal leg of the L-shaped groove or slot and said electrical terminal of said bulb base is properly aligned for making contact with a particular electrical terminal of the bulb socket.

34. The bulb base of claim 33 wherein said means for retaining includes a retaining lever integrally formed from said body and being flexibly attached to said body at a proximate end, said retaining lever having a distal end movable between said first and second positions.

35. The bulb base of claim 34 wherein said retaining lever further includes a retainer integrally formed from said distal end, said retainer extending outwardly from said retaining lever and being generally perpendicularly to said body such that said retainer is selectively received in and engaged with the horizontal leg of the L-shaped groove or slot when said retaining lever is in said first position and thereby retaining said bulb base in the bulb socket.

36. The bulb base of claim 35 wherein said retainer includes a lead-in surface for slidably engaging an edge of the bulb socket.

37. The bulb base of claim 36 wherein said retainer is generally wedge-shaped cross-section.

38. The bulb base of claim 36 wherein said retainer is generally hemispherical in shape.

39. The bulb base of claim 38 wherein said retainer includes a short generally flat surface at its intersection with said retainer lever for providing a positive engagement with the horizontal leg of said L-shaped groove or slot.

40. The bulb base of claim 33 wherein said means for aligning includes at least one alignment rib integrally formed from said body and positioned to be slidably received in a vertical leg of the L-shaped retaining groove or slot of the bulb socket.

41. The push-in base of claim 34 wherein said body further defines a relief immediately adjacent said retainer lever such that said retainer lever is received within said relieve as said retainer lever is moved to said second position.

42. The push-in base of claim 34 wherein said bulb base includes a second retainer lever diametrically opposed to said at least one retainer lever and having a retaining means at its distal end for engaging a second horizontal leg of a second L-shaped retaining groove or slot diametrically opposed to the at least one L-shaped retaining groove or slot of the bulb socket.

43. The push-in base of claim 33 wherein additional said printed circuit boards can be slidably received on said upper portion, each of said additional printed circuit boards being spaced apart one from another by a spacer slidably received on said upper portion.

44. The push-in base of claim 43 wherein said additional printed circuit boards are electrically connected together by a pin-type electrical connector.

45. The push-in base of claim 33 wherein a top plate is attached to said upper portion, said top plate for protecting said printed circuit boards and providing a handle for inserting and removing said base from the bulb socket.

46. The push-in base of claim 33 wherein said alignment means includes the geometric cross-sectional shape of the translucent housing and said at least one printed circuit board having a corresponding cross-sectional shape such that it can be slidably received within the translucent housing in only one orientation.

47. The push-in base of claim 33 wherein said alignment means includes at least one aligning rib extending longitudinally along an inside surface of the translucent housing and at least one corresponding peripheral slot in said at least one printed circuit board.

48. The push-in base of claim 45 wherein said alignment means includes at least one aligning rib extending longitudinally along an inside surface of the translucent housing and at least one corresponding peripheral slot in said top plate.

* * * * *